US005988992A

United States Patent [19]

Tetzlaff et al.

[11] Patent Number: 5,988,992

[45] Date of Patent: Nov. 23, 1999

[54] RETRIEVABLE PROGRESSING CAVITY PUMP ROTOR

[75] Inventors: Steven K. Tetzlaff, Huntington Beach; David B. Dillon, Laguna Nigel, both of Calif.; Edward C. Kanady, Tulsa, Okla.; David L. Olson, Los Alamatos, Calif.

[73] Assignee: Baker Hughes Incorporated

[21] Appl. No.: 09/048,419

[22] Filed: Mar. 26, 1998

[51] Int. Cl.[6] ..... F04B 35/00

[52] U.S. Cl. ..... 417/360; 417/424.2; 418/48; 166/98

[58] Field of Search ..... 417/360, 424.2; 418/48; 166/98

[56] References Cited

U.S. PATENT DOCUMENTS

| | | | |
|---|---|---|---|
| 4,706,745 | 11/1987 | Bishop et al. | 166/98 |
| 4,877,085 | 10/1989 | Pullig, Jr. | 166/98 |
| 5,510,281 | 4/1996 | Round | 418/48 |
| 5,746,582 | 5/1998 | Patterson | 418/48 |
| 5,765,638 | 6/1998 | Taylor | 166/98 |

*Primary Examiner*—Charles G. Freay
*Assistant Examiner*—Cheryl J. Tyler
*Attorney, Agent, or Firm*—James E. Bradley

[57] ABSTRACT

A progressive cavity pump housing is secured to the lower end of a string of tubing. A motor is secured to the progressive cavity housing. An electrical power cable is strapped to the motor alongside the tubing. The pump has a pump rotor located within a stator. The pump rotor has a driven shaft extending downward from its lower end which mates with a drive shaft extending upward from the motor. When the pump reaches the motor, the driven shaft will stab into the drive shaft. The upper end of the pump rotor extends above the stator and is configured to engage an overshot retrieval tool. To retrieve the rotor, the operator lowers an overshot retrieval tool through the production tubing and latches it to the upper end of the pump rotor. The operator pulls the rotor out of the pump, thereby disengaging the rotor from the drive shaft of the motor, and leaving the remainder of the pump and the motor in place. After flushing the pump stator, the rotor may be lowered back through the tubing into the stator and reengaged to the drive shaft.

17 Claims, 2 Drawing Sheets

RETRIEVABLE PROGRESSING CAVITY PUMP ROTOR

CROSS-REFERENCE TO RELATED APPLICATION

This application is related to commonly assigned patent application Ser. No. 08/753,158, filed Nov. 21, 1996, pending, entitled Wireline/Coiled Tubing Retrievable Pump incorporated herein by reference.

TECHNICAL FIELD

This invention relates in general to well pumps, and in particular to a well pump which is operated by a submersible electric motor and having a pump rotor which is retrievable through tubing.

BACKGROUND ART

Electrical submersible well pumps for deep wells are normally installed within casing on a string of tubing. Usually the tubing is made up of sections of pipe which are screwed together. The motor is supplied with power through a power cable that is strapped alongside the tubing. The pump is typically located above the motor and connected to the lower end of the tubing. The pump pumps fluid through the tubing to the surface. One type of a pump, a centrifugal pump, uses a large number of stages and is particularly suited for large pumping volume requirements.

For lesser pumping volume requirements, a progressing cavity or PC pump may be employed. PC pumps utilize a helical rotor that is rotated inside an elastomeric stator which has double helical cavities. PC pumps may be surface driven or bottom driven. Surface driven PC pumps have a rod which extends down to the pump in the well, whereas bottom driven PC pumps are driven by electric motors located in the well.

PC pumps are widely used in applications where significant quantities of solids, such as sand and scale, are likely to be encountered. When a large volume of solids enter the pump, the pump may not be able to remove the solids, causing the pump to lock up. Lock up can also occur if the pump assembly shuts down for any reason. The solids in the tubing string settle back down on top of the pump, again causing it to lock up. When this situation occurs on a standard surface-driven PC application, the rod string is pulled from the well bringing the pump rotor with it. The tubing and pump stator are then flushed and circulated until they are clean before the pump rotor and rod string are reinstalled into the pump stator. Bottom-driven PC pumps present a significant drawback to accomplishing this procedure. The same conditions that lock-up surface driven applications also apply to the bottom drive systems.

SUMMARY OF INVENTION

A motor is secured to the lower end of a string of tubing. An electrical power cable is connected to the motor and strapped alongside the tubing. A progressive cavity submersible pump housing is mounted to the motor and to the tubing. The pump housing has a stator which receives a pump rotor. The pump rotor has a driven shaft extending downward from its lower end which mates with a drive shaft extending upward from the motor. The pump rotor is lowered through the tubing into the pump stator. When the lower end of the pump rotor reaches the motor, the driven shaft will stab into the drive shaft. The upper end of the pump rotor is configured to engage an overshot retrieval tool.

When it is desirable to remove the pump rotor to clean out the pump stator, the operator lowers an overshot retrieval tool through the production tubing and latches it to the upper end of the pump rotor. The operator pulls the rotor out of the pump housing, thereby disengaging the driven shaft from the drive shaft of the motor, and leaving the remainder of the pump and the motor in place. Subsequently, after flushing out the pump stator, the rotor is lowered back through the tubing into the stator and reengaged to the drive shaft.

BEST MODE FOR CARRYING OUT THE INVENTION

Figure 1A:
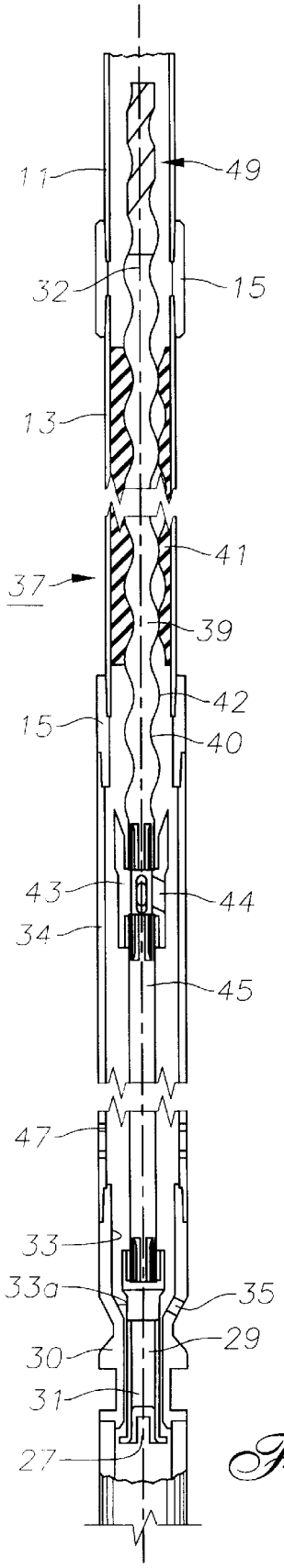
FIG. 1A is a sectional side view of a pump on an upper end of a pump assembly which is constructed in accordance with the invention.

Referring to FIG. 1A, a string of production tubing 11 extends from the surface into a cased well. Production tubing 11 is a conduit made up of sections of pipe which are screwed together with threaded collars 15.Tubing 11 may be approximately four inches in diameter. A tubular pump housing 13 is located at the lower end of tubing 11. Pump housing 13 is connected to tubing 11 with a threaded collar 15. Pump housing 13 may have an outer diameter that is the same as or larger than the outer diameter of tubing 11.

Figure 1B:
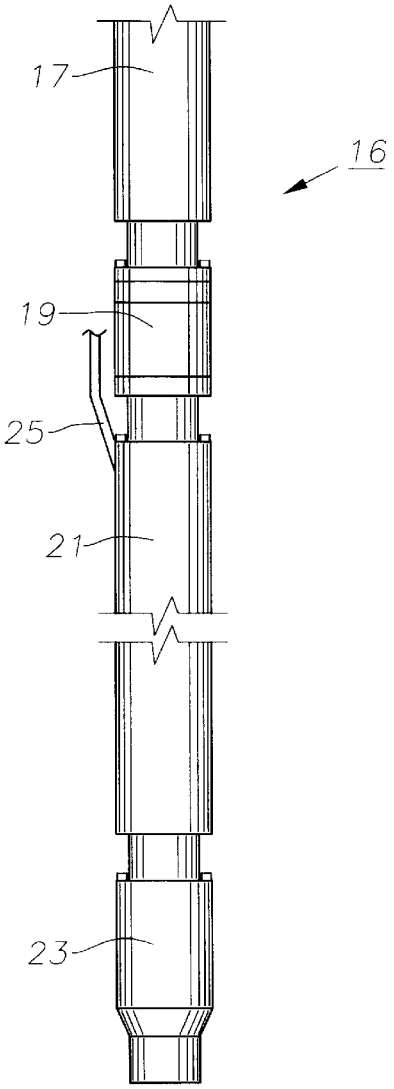
FIG. 1B is a side view of a motor on a lower end of the pump assembly of FIG. 1A.

Referring now to FIG. 1B, a motor assembly 16 is secured to the lower end of pump housing 13. Motor assembly 16 includes a seal section 17 which is mounted to a gear reducer 19. Gear reducer 19 is mounted to an AC electric motor 21. In the embodiment shown, motor 21 has a pressure sensor 23 secured to its lower end for sensing pressure in the well. A three-phase electrical power cable 25 connects to motor 21 and extends alongside tubing 11 (FIG. 1A) to the surface for receiving electrical power. Motor 21 typically operates at about 3600 rpm, which is reduced by gear reducer 19 to a lower speed. Seal section 17 seals well fluid from the interior of motor 21 and also equalizes pressure differential between the lubricant in motor 21 and the exterior.

As shown in FIG. 1A, a drive shaft 27 extends upward from seal section 17 and is driven by motor 21. Drive shaft 27 has a coupling 29 on its upper end. Coupling 29 has a splined receptacle on an upper end. Coupling 29 is located within a reduced diameter housing 30 which is mounted to the lower end of a tubular housing 34. The lower end of housing 30 connects to seal section 17. Bearings or bushings 31 rotatably support coupling 29 on a central axis 32. Housing 30 has cylindrical walls 33 which lead to a lower conical portion 33*a* which tapers downward. A drain hole 35 is located conical portion 33*a* for egress of debris.

A progressing cavity (PC) pump 37 is driven by motor 21. PC pump 37 has a metal rotor 39 which has an exterior helical configuration and a splined lower end. Rotor 39 has undulations with small diameter portions 40 and large diameter portions 42 which give rotor 39 a curved profile relative to axis 32. Rotor 39 orbitally rotates within an elastomeric stator 41 which is located in pump housing 13. Stator 41 has double helical cavities located along axis 32 through which rotor 39 orbits.

A flexible shaft coupling 43 has a splined receptacle which receives the splined lower end of rotor 39. The lower end of rotor 39 merely sits in the receptacle of coupling 43. During operation, gravity and the reaction force due to rotor 39 pumping fluid upward will keep the lower end of rotor 39 engaged to coupling 43. The splined upper end of a flexible shaft 45 is mounted in and pinned to a splined receptacle in the lower end of coupling 43. Coupling 43 also has a plurality of drain ports 44 which extend from its upper receptacle through its side. Flexible shaft 45 flexes off of axis 32 at its upper end to allow rotor 39 to orbit. The splined lower end of flexible shaft 45 undergoes pure axial rotation as it is mounted in and pinned to a splined receptacle in the upper end of coupling 29. A plurality of intake ports 47 are located in the lower portion of pump housing 13. Well fluid pumped by pump 37 is drawn in through intake ports 47 and port 35.

Figure 2:
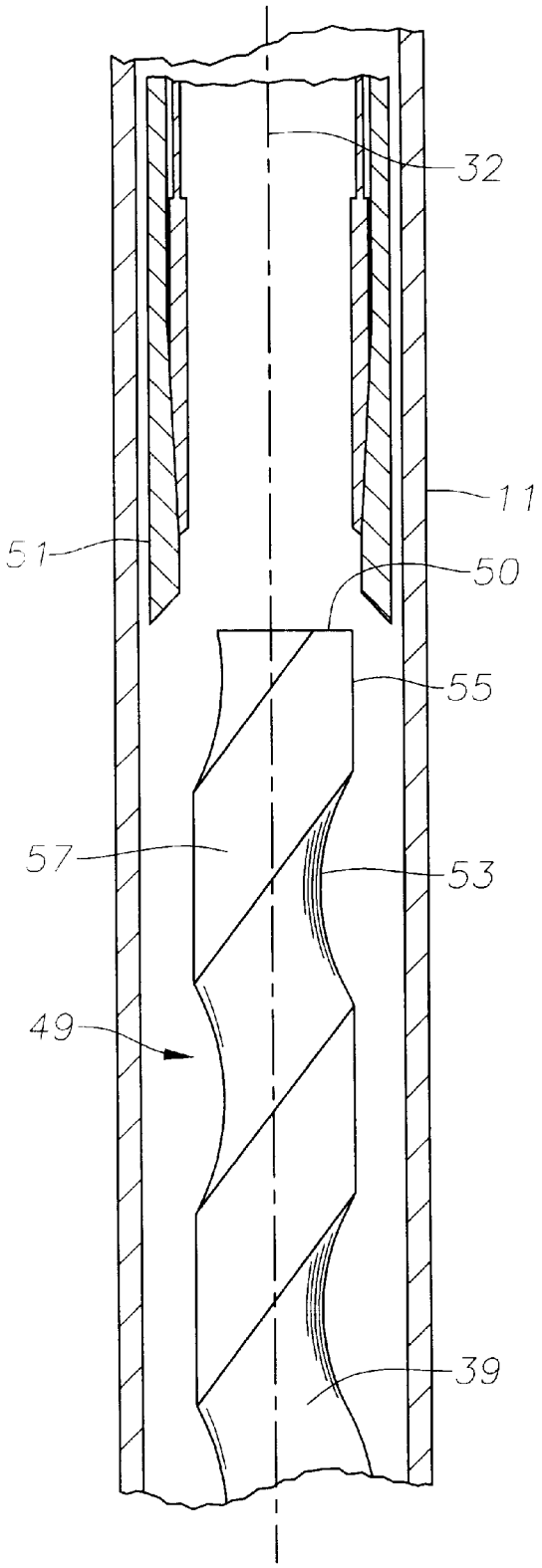
FIG. 2 is an enlarged, partial sectional side view of the upper end of the rotor of FIG. 1A prior to retrieval with an overshot retrieval tool.

Referring to FIGS. 1A and 2, an upper end of rotor 39 has been modified to provide a gripping section 49 for a conventional overshot retrieval tool 51. Gripping section 49 is helical as described above for rotor 39 and has a flat upper end 50 which is generally perpendicular to axis 32. Gripping section 49 also has undulations with small diameter portions 53 and large diameter portions 55. Small diameter portions 53 are unaltered and identical to the shape shown for rotor 39. However, the curved outer surfaces of large diameter portions 55 have been flattened, parallel to axis 32, and given a texture 57. In the embodiment shown, the texture 57 on portions 55 comprises small grooves which are perpendicular to axis 32 provides a better gripping surface for overshot retrieval tool 51.

Figure 3:
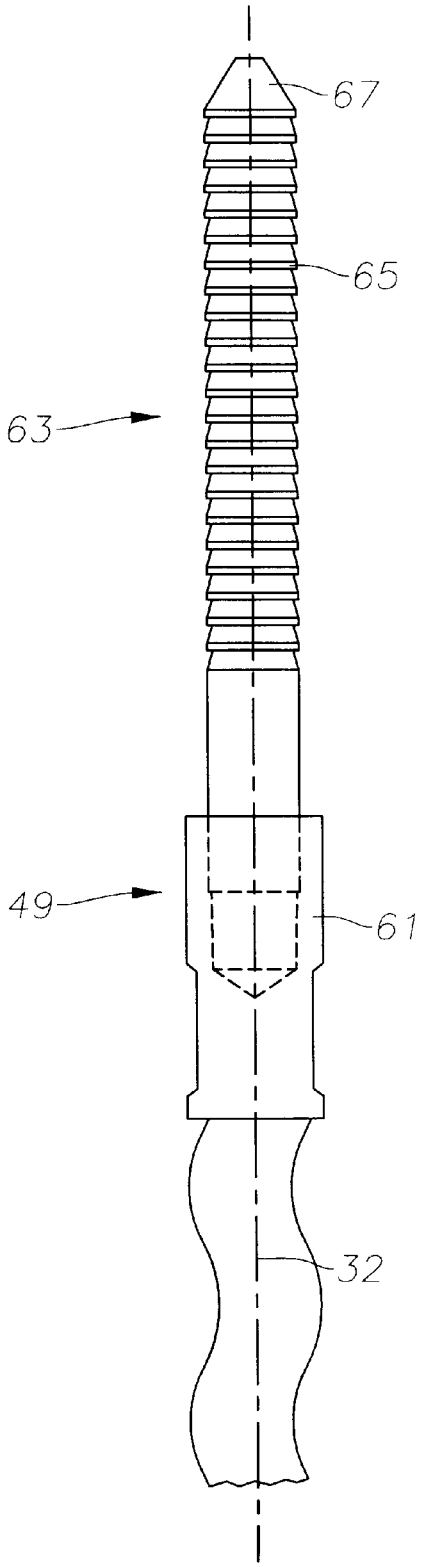
FIG. 3 is an enlarged side view of an alternate embodiment for the upper end of a rotor for the pump of FIG. 1A.

An alternative embodiment for gripping section 49 is depicted in FIG. 3. In this version, a coupling 61 is secured to the upper end of rotor 39. A grip rod 63 is rigidly mounted to and extends upward from the opposite end of coupling 61. Grip rod 63 has a plurality of small, parallel ribs or grooves 65 along its length, and a conical upper end 67. Grooves 65 are perpendicular to axis 32 and conical. Each groove 65 has a smaller diameter upper edge and a larger diameter lower edge. Grooves 65 are provided for giving overshot retrieval tool 51 a better gripping surface.

In operation, an operator assembles the pump components (FIG. 1A) including pump 37, flexible shaft 45, couplings 29, 43, housing 13, pump housing 13 and tubing 11. Next, motor assembly 16 (FIG. 1B), including motor 21, pressure sensor 23, gear reducer 19 and seal section 17, is connected to the lower end of housing 30. Power cable 25 is strapped alongside tubing 11 as the assemblies are lowered into the well to a desired depth.

When power is supplied through power cable 25, motor 21 rotates couplings 29, 43 and flexible shaft 45, thereby causing rotor 39 to orbit relative to axis 32 (FIG. 1A). The orbital interaction between rotor 39 and stator 41 causes well fluid to be drawn into the interior of housing 30 and pump housing 13 through intake ports 35, 47, respectively. The well fluid flows out the upper end of pump 37, past the freely orbiting upper end and gripping section 49 of rotor 39 and into tubing 11. The well fluid then flows through production tubing 11 to the surface.

In the event that solid debris lodges in stator 41, thereby locking rotor 39, rotor 39 may be removed from pump housing 13 without retrieving pump stator 41 or motor 21 to the surface. To do so, a conventional overshot retrieval tool 51 (FIG. 2) or similar means is lowered on a line through tubing 11. Tool 51 is stabbed onto and receives the free upper end of rotor 39 (not shown), engaging texture 57 on large diameter portions 55. Alternatively, tool 51 may be similarly used to engage grooves 65 on grip rod 63 (FIG. 3). Rotor 39 is then pulled upward with tool 51, thereby disengaging the lower end of rotor 39 from the splined receptacle in the upper end of coupling 43. Only rotor 39 is retrieved and moved upward. Stator 41, coupling 43, flexible shaft 45 and the remainder of the pump and motor assemblies remain in the well as originally installed while rotor 39 is pulled to the surface. The operator will then pump a flushing liquid (not shown) down tubing 11. The flushing liquid flows out ports 35, 47 and circulates back to the surface through the annulus surrounding tubing 11. Any solid debris that may have settled in the upper receptacle of coupling 43 should flow out through drain ports 44. Rotor 39 is replaced by reversing the steps described above.

The invention has significant advantages. By leaving the motor and pump in place and retrieving only the rotor, the operation to clean out the pump is much faster than pulling tubing. In the case of production tubing, a workover rig need not be employed for pulling the tubing. Damage to the power cable is avoided as the production tubing will remain in place. Reducing the expense of changing out the rotor reduces the cost of using a pump of this nature in the well.

While the invention has been shown in only some of its forms, it should be apparent to those skilled in the art that it is not so limited but is susceptible to various changes without departing from the scope of the invention.

We claim:

1. An apparatus for pumping fluid from a well, comprising in combination:

a conduit adapted to extend into the well;

a progressive cavity pump stator secured to the conduit;

an electric motor assembly having a drive shaft and carried by the pump stator; and a helical rotor located within the pump stator and having a lower end which engages the drive shaft of the motor assembly and an upper end portion which protrudes above the stator and is adapted to be engaged by a retrieval tool and pulled through the conduit for retrieving the rotor while the motor assembly and the pump stator remain stationary.

2. The apparatus according to claim 1, further comprising a flexible shaft coupled between the drive shaft of the motor assembly and the lower end of the rotor.

3. The apparatus according to claim 2 wherein one end of the flexible shaft rotates about a central axis of the pump assembly and another end of the flexible shaft orbits around the central axis of the pump assembly.

4. The apparatus according to claim 2, further comprising a coupling secured to an upper end of the flexible shaft, the coupling having a splined member for engagement by the lower end of the rotor.

5. The apparatus according to claim 2, further comprising a coupling secured to an upper end of the flexible shaft, the coupling having an upward-facing splined receptacle for engaging the lower end of the rotor.

6. The apparatus according to claim 1 wherein the upper end portion of the rotor has an exterior side wall having a grooved texture for facilitating engagement between the retrieval tool and the rotor.

7. The apparatus according to claim 1 wherein the upper end portion of the rotor has a sidewall containing grooves which are perpendicular to an axis of the rotor for facilitating engagement between the retrieval tool and the rotor.

8. The apparatus according to claim 1 further comprising a power cable extending from the motor assembly alongside the conduit for connection to a power source at the surface.

9. A well pump assembly, comprising in combination:

a progressive cavity pump housing having a stator therein, the pump housing being adapted to be secured to a string of conduit;

an electric motor which rotates a drive shaft and is carried by the pump housing;

a power cable adapted to be strapped alongside the conduit from the motor to the surface for connection to a power source; and a helical rotor located within the stator and having a lower end for engaging the drive shaft of the motor assembly and an upper end portion which protrudes above the stator while installed therein, the upper end portion being adapted to be engaged by a retrieval tool and pulled through the conduit for retrieving the rotor while the motor assembly and the pump housing and stator remain stationary.

10. The apparatus according to claim 9, further comprising a flexible shaft coupled between the drive shaft of the motor and the lower end of the rotor.

11. The apparatus according to claim 10 wherein one end of the flexible shaft rotates about a central axis of the pump housing and another end of the flexible shaft orbits around the central axis of the pump housing.

12. The apparatus according to claim 10, further comprising a coupling secured to an upper end of the flexible shaft, the coupling having a splined member for engagement by the lower end of the rotor.

13. The apparatus according to claim 10, further comprising a coupling secured to an upper end of the flexible shaft, the coupling having an upward-facing splined receptacle for engaging the lower end of the rotor.

14. The apparatus according to claim 9 wherein the upper end portion of the rotor has an exterior side wall having a grooved texture for facilitating engagement between the retrieval tool and the rotor.

15. The apparatus according to claim 9 wherein the upper end portion of the rotor has a sidewall containing grooves which are perpendicular to an axis of the rotor for facilitating engagement between the retrieval tool and the rotor.

16. A method for flushing a pump stator, comprising:

providing an electric motor assembly having a drive shaft at an upper end;

providing a progressive cavity pump assembly which has a stator and a rotor which has a lower end extending below the stator and an upper end extending above the stator;

securing the pump assembly to a lower end of a string of conduit, securing the motor assembly to the pump assembly with the lower end of the rotor engaging the drive shaft, and lowering the motor and pump assemblies into the well on the conduit to a desired depth;

supplying power to the motor assembly which rotates the rotor, causing well fluid to be pumped through the conduit to the surface; then, if it is desired to remove the rotor, lowering a retrieval tool through the conduit and engaging the retrieval tool with the upper end portion of the rotor; then pulling the retrieval tool and rotor to the surface through the conduit.

17. The method of claim 16, further comprising:

pumping fluid through the stator from the surface to flush the stator; and lowering the rotor through the conduit back into the stator and into engagement with the drive shaft.

* * * * *